United States Patent [19]

Cummings

[11] Patent Number: 4,903,795

[45] Date of Patent: Feb. 27, 1990

[54] MOVABLE SCAFFOLD RUNG

[76] Inventor: Michael P. Cummings, 1547 N. 11th St., Cambridge, Ohio 43725

[21] Appl. No.: 260,697

[22] Filed: Oct. 21, 1988

[51] Int. Cl.[4] ..... E04G 1/26

[52] U.S. Cl. ..... 182/92; 182/179; 182/228

[58] Field of Search ..... 182/228, 178, 179, 194, 182/92

[56] References Cited

U.S. PATENT DOCUMENTS

| | | | |
|---|---|---|---|
| 1,116,073 | 11/1914 | Johnson | 182/228 |
| 2,635,717 | 4/1953 | Albrecht | 182/179 |
| 3,071,204 | 1/1963 | Piltingsrud | 182/179 |
| 3,266,208 | 8/1966 | Maggs | 182/179 |
| 4,082,162 | 4/1978 | Diez | 182/228 |
| 4,632,221 | 12/1986 | Stamford | 182/179 |

*Primary Examiner*—Reinaldo Machado

*Attorney, Agent, or Firm*—Watkins, Dunbar & Pollick

[57] ABSTRACT

Construction scaffolding comprising adjacent end frames with joined vertical support members is provided with movable rung members that are extendible and retractable, that engage the exterior surface of the vertical support members, and that are secured to the support members by clamp members having quick-release threaded fasteners.

2 Claims, 1 Drawing Sheet

MOVABLE SCAFFOLD RUNG

TECHNICAL FIELD OF THE INVENTION

This invention relates generally to construction industry scaffolding, and particularly concerns a movable and insertable scaffold rung.

BACKGROUND OF THE INVENTION

It is well known to temporarily construct a scaffolding near and associated with a construction project that rises above the ground. The scaffold provides a means of holding construction materials and workers who apply the materials to the project.

Scaffolds are typically made of tubular materials that interconnect with hinge joints or other means. Vertical support members are arranged to act as columns and are fixedly connected to horizontal and tangential brace members to provide a structure of sufficient strength to carry the load of the scaffold, the load of the materials, and the load of the workers as the scaffold increases in height.

Typical scaffolding constructions utilize scaffold end frames having fixed horizontal support members that function as ladder rungs. Typically such horizontal support rungs do not extend the full width of the scaffold and this limits the width of the work surface that may be formed by placing work planks on the rungs.

Such fixed rungs are usually welded in place. Such an arrangement limits the number of working levels that may be formed by placing work planks on horizontal support members and between adjacent scaffold end frames.

It is an advantage to be able to establish a wide working surface at as many levels as necessary so that the work may be conveniently applied to the construction surface to which the scaffold is associated.

Others have sought to provide improvements to scaffolding as shown by the following U.S. Patents:

U.S. Pat. No. 2,476,863 to Hawes discloses merely a scaffolding clamp that may be used to join vertical and horizontal scaffold members. Similarly, U.S. Pat. No. 2,876,027 to Sulmonetti discloses a scaffold clamp instruction but of the swivel type.

U.S. Pat. No. 3,071,204 to Piltingsrud teaches a scaffold having adjustable vertical supports and adjustable diagonal bracing. U.S. Pat. No. 3,092,207 to Larder discloses a replaceable ladder rung but of a different construction.

U.S. Pat. No. 3,998,562 to Gostling teaches a scaffold support collar to be attached to a scaffold vertical support to receive horizontal support or rung members. U.S. Pat. No. 4,082,162 to Diez teaches a ladder extension construction having rungs which may be extended longitudinally to facilitate assembly but which are positioned at fixed levels.

Lastly, U.S. Pat. No. 4,111,579 to Knight teaches a scaffold clamp construction which does permit horizontal support members (rungs) to be positioned at different vertical levels relative to the scaffold vertical supports but does not provide the clamps integral with the horizontal rung.

To overcome the prior art shortcoming of failure to provide a scaffold with end frames having only fixed rungs with an added capability for supporting a work platform at additional levels, I have devised a novel scaffold construction with movable scaffold rungs.

SUMMARY OF THE INVENTION

Briefly, my invention utilizes basic scaffold end frames having a vertical center support and opposite vertical outer supports. Fixed ladder rungs extend in some instances between one of the vertical outer supports and the vertical center support and one of the vertical outer supports.

My invention provides a movable rung which may be retracted and extended for scaffold assembly purposes. Each end of the collapsible rung has an attached, selectively operable, clamp which cooperates with one of the scaffold vertical supports. Quick-release threaded fasteners are preferably utilized with the rung end clamps.

The foregoing and other advantages of the invention will become apparent from the following disclosure in which preferred embodiments of the invention are described in detail and illustrated in the accompanying drawings. It is contemplated that variations in structural features and arrangement of parts may appear to the person skilled in the art, without departing from the scope or sacrificing any of the advantages of the invention.

DETAILED DESCRIPTION OF THE INVENTION AND BEST MODE FOR CARRYING OUT THE PREFERRED EMBODIMENT

Figure 1:
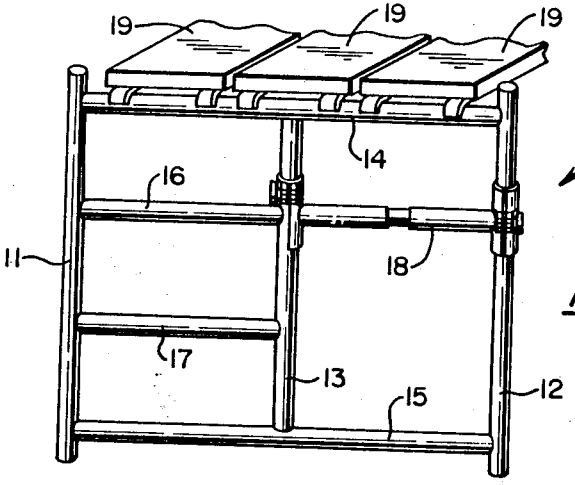
FIG. 1 is an elevational view, partially in perspective, of a scaffold end frame having a movable scaffold rung constructed in accordance with my invention.

FIG. 1 illustrates a scaffold end frame 10 typically comprised of outer vertical supports 11 and 12, center vertical support 13, and upper and lower horizontal supports, or rungs, 14 and 15 which join outer vertical supports 11 and 12 together. Center vertical support 13 joins support members 14 and 15 together, and additionally, fixed horizontal rungs 16 and 17 join center vertical support 13 to one of the vertical outer supports such as 11. Components 11 through 17 of the FIG. 1 assembly are typically fabricated of tubular steel joined together by conventional welding. Assembly 10 also includes a movable scaffold rung 18 constructed and installed in accordance with my invention.

FIG. 1 also shows work platform plank members 19 which are supported in part by horizontal support rung 14. In accordance with my invention, movable rung 18 may be positioned at different levels intermediate members 14 and 15 and may be removably clamped at each of its ends to a vertical support member. Also, additional plank members 19 may be partially supported by rung 18 and between like rungs in adjacent scaffold frames 10 to provide a further work platform.

Figure 3:
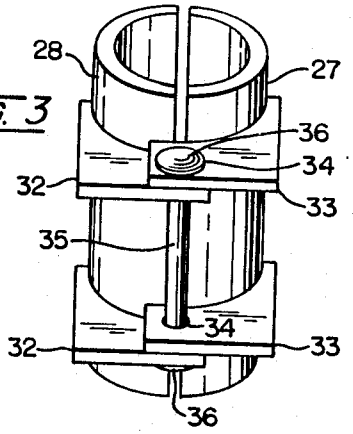
FIG. 3 is a rear view of a clamp portion of the movable scaffold rung construction shown in FIGS. 1 and 2.
Figure 2:
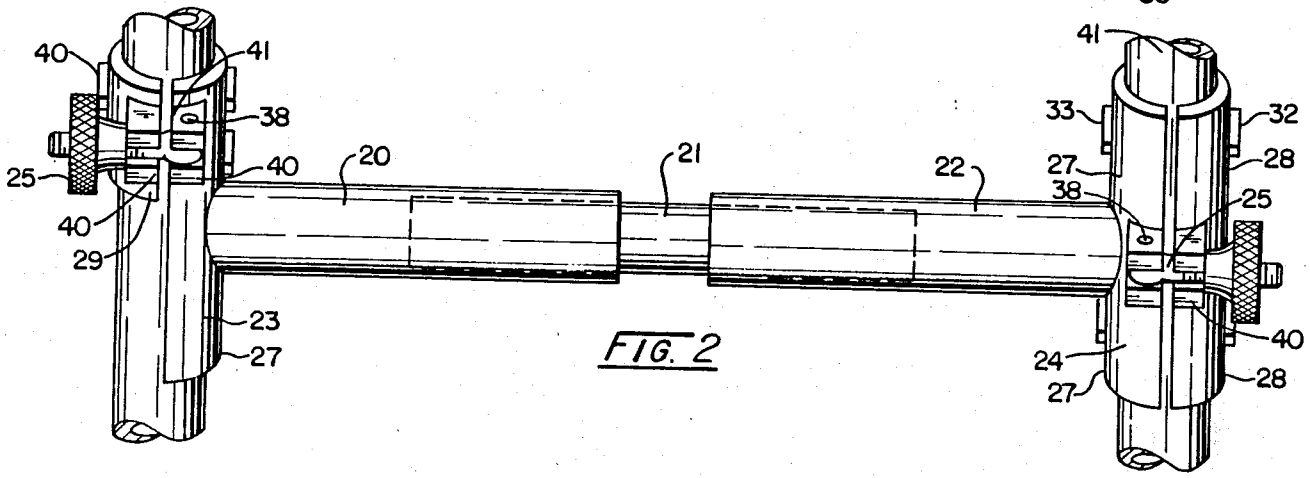
FIG. 2 is an enlarged and detailed view of the movable scaffold rung installation of FIG. 1.

FIG. 2 illustrates rung assembly 18 in further detail. Such assembly is comprised of a rung portion 20 which has an integral rung pin 21 that slidably engages the interior surface of an opposite rung portion 22. The rung portion 20 has a clamp assembly 23 fixedly attached to the end opposite rung portion 22; and rung portion 22 has a clamp assembly 24 fixedly attached to the end opposite rung portion 20. Each clamp assembly is comprised of essentially semi-cylindrical halves 27, 28 that are hingedly joined about a vertical axis, (as shown in FIG. 3). Additionally, each clamp assembly includes a pivotal tension screw means 41 and threaded quick-release fastener 25 that releasably joins the clamp assembly semi-cylindrical halves 27, 88 together. The clamp 24 semi-cylindrical halves 27, 28 are sized to engage the cylindrical surfaces of frame vertical support members 11 through 13. Also, one of the semi-cylindrical halves 29 of one of the assembly clamp members 25 is made shorter than the opposite to provide a clearance of any adjacent rung member 16 or 17 when so installed. Thus, removable rung 18 may be installed at the same working level as one of the frame's intermediate fixed rungs 16 or 17.

Referring to FIG. 3, the clamp halves 27 and 28 are provided with lateral hinge members 32 and 33. The hinge members 32 and 33 are provided with apertures 34 to receive a hinge pin 35 which is formed with a head 36 at opposite extremities.

In operation, when the movable rung is to be installed, the fasteners 25 are rotated to their extreme outer positions and beyond the edges of the tabs 40 allowing the fastener 25 assembly to pivot outward on the pivot pin 38. This allows the clamp halves 28 to be rotated on the hinge pin 35 to an open position. The rung is then slidably compressed in length on the rung pin 21 to a distance short enough that the rung may be inserted between the vertical members 12 and 13. When properly aligned the clamp halves 28 and 29 are rotated to a closed position and the fasteners 25 are rotated to a position over bearing the tabs 40, at which time the fastener knobs 25 are threadedly rotated until they tightly engage the tabs 40, applying clamping pressure on the clamp halves 27, 28, and 29, holding the rung in place.

When the movable rung 18 is properly installed in each of adjacent scaffold frames 10, the assembled construction scaffolding is provided with a further capability for receiving work platform planks at an additional scaffold level or levels.

It is herein understood that although the present invention has been specifically disclosed with the preferred embodiments and examples, modifications and variations of the concepts herein disclosed may be resorted to by those skilled in the art. Such modifications and variations are considered to be within the scope of the invention and the appended claims.

I claim:

1. A construction scaffolding movable rung assembly constructed to fit between an outside vertical support of the scaffolding and an intermediate vertical support spaced between the outside supports of the scaffolding, and constructed to be positioned as an extension of a fixed horizontal rung that is between the intermediate vertical support and an outer vertical support to provide an extension of the horizontal rung to another outer vertical support, said movable rung assembly comprising:

(a.) first rung portion having a tubular configuration;

(b.) a second rung portion having a tubular configuration and an integrally attached pin member that slidably engages the interior of said first rung portion;

(c.) a first semi-cylindrical clamp portion fixably secured to extreme opposite ends of said movable rung portion;

(d.) a second semi-cylindrical clamp portion hingedly joined to said first semi-cylindrical clamp portion at one end of said movable rung;

(e.) a third semi-cylindrical clamp portion hingedly joined to the other semi-cylindrical clamp portion at the opposite end of said movable rung, said third semi-cylindrical clamp portion constructed to be above said intermediate horizontal rung of the scaffolding when the movable rung assembly is in position between the intermediate and vertical support and the outer vertical support; and (f.) quick disconnect thread fastener means releasably joining said first semi-cylindrical clamp portions to said second and third semi-cylindrical clamp portions, wherein the quick disconnect fastener means comprises at least one tab on each clamp half with a threaded tension screw means pivotly connected to one of said tabs having a fastener knob threaded thereon, with the fastener knob and screw means rotatable to engage at least one tab on the other clamp half, providing a clamping effect between the clamp halves when the fastener knob is screwed down on the said other tab.

2. A construction scaffolding movable rung according to claim 1 wherein said third semi-cylindrical clamp portion is constructed to engage and bear upon said fixed horizontal rung, aligning the movable rung and the fixed horizontal rung and preventing the movable rung from sliding on the intermediate vertical support, so that the alignment between the fixed horizontal rung and the movable rung assembly provides a continuous horizontal rung construction from one outer support to another outer support.

* * * * *